US010504472B2

(12) United States Patent
Dai et al.

(10) Patent No.: US 10,504,472 B2
(45) Date of Patent: Dec. 10, 2019

(54) SOURCE DRIVE CIRCUIT AND DISPLAY DEVICE

(71) Applicants: BOE Technology Group Co., Ltd., Beijing (CN); Hefei Xinsheng Optoelectronics Technology Co., Ltd., Hefei (CN)

(72) Inventors: Ke Dai, Beijing (CN); Wenwu Lu, Beijing (CN); Chunyang Nie, Beijing (CN); Xiaoliang Cheng, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 15 days.

(21) Appl. No.: 15/576,373

(22) PCT Filed: May 10, 2017

(86) PCT No.: PCT/CN2017/083715

§ 371 (c)(1),
(2) Date: Nov. 22, 2017

(87) PCT Pub. No.: WO2018/094973

PCT Pub. Date: May 31, 2018

(65) Prior Publication Data

US 2018/0374446 A1 Dec. 27, 2018

(30) Foreign Application Priority Data

Nov. 24, 2016 (CN) ..... 201611053935.1

(51) Int. Cl.
*G09G 3/36* (2006.01)

(52) U.S. Cl.
CPC ... *G09G 3/3688* (2013.01); *G09G 2310/0291* (2013.01); *G09G 2310/08* (2013.01);
(Continued)

(58) Field of Classification Search
CPC ..... G09G 3/3688; G09G 2310/0291; G09G 2310/08; G09G 2320/0693
See application file for complete search history.

(56) References Cited

U.S. PATENT DOCUMENTS 6,137,462 A * 10/2000 Kim ..... G09G 3/2011 345/100
2008/0266222 A1 10/2008 Feng
(Continued)

FOREIGN PATENT DOCUMENTS

CN 101295110 A 10/2008
CN 101303941 A 11/2008
(Continued)

OTHER PUBLICATIONS

Aug. 25, 2017—(WO) International Search Report and Written Opinion Appn PCT/CN2017/083715 with English Tran.

*Primary Examiner* — Towfiq Elahi
(74) *Attorney, Agent, or Firm* — Banner & Witcoff, Ltd.

(57) ABSTRACT

A source drive circuit and a display device. The source drive circuit includes: a detection circuit, configure to detect a change value of a common voltage; and a compensation circuit, configured to obtain a compensation data signal based on a data signal and the change value of the common voltage, and output the compensation data signal to a pixel electrode of a display panel.

10 Claims, 4 Drawing Sheets

(52) U.S. Cl.
CPC ..... *G09G 2320/0219* (2013.01); *G09G 2320/0693* (2013.01)

(56) References Cited

U.S. PATENT DOCUMENTS

| | | | | |
|---|---|---|---|---|
| 2008/0291181 | A1* | 11/2008 | Nam | G09G 3/3611 345/204 |
| 2016/0086561 | A1* | 3/2016 | Kim | G09G 3/3655 345/92 |
| 2016/0180816 | A1 | 6/2016 | Hwang et al. | |
| 2016/0210930 | A1 | 7/2016 | Lee et al. | |
| 2016/0307536 | A1* | 10/2016 | Okabe | G02F 1/1368 |

FOREIGN PATENT DOCUMENTS

| | | | |
|---|---|---|---|
| CN | 104199204 | A | 12/2014 |
| CN | 104680997 | A | 6/2015 |
| CN | 105702195 | A | 6/2016 |
| CN | 105810161 | A | 7/2016 |

* cited by examiner

SOURCE DRIVE CIRCUIT AND DISPLAY DEVICE

The application is a U.S. National Phase Entry of International Application No. PCT/CN2017/083715 filed on May 10, 2017, designating the United States of America and claiming priority to Chinese Patent Application No. 201611053935.1, filed Nov. 24, 2016. The present application claims priority to and the benefit of the above-identified applications and the above-identified applications are incorporated by reference herein in their entirety.

TECHNICAL FIELD

Embodiments of the present disclosure relate to a source drive circuit and a display device.

BACKGROUND

A common voltage line and a data line in a liquid crystal display panel form a capacitance. In a case that a data signal on the data line is changed, due to the capacitance between the common voltage line and the data line, a common voltage VCOM on the common voltage line is pulled and changed. Especially for a HADS (High advanced super Dimension Switch) display mode, because the capacitance between the common voltage line and the data line is relatively large, the change of the common voltage VCOM on the common voltage line is greater when the common voltage VCOM is pulled. The pulling of the common voltage is more difficult to recover, which is easily cause an error of a charging voltage on a pixel, so as to lead to residual charge and cause residual image.

SUMMARY

At least one embodiment of the present disclosure provides a source drive circuit, which comprises: a detection circuit, configure to detect a change value of a common voltage; and a compensation circuit, configured to obtain a compensation data signal based on a data signal and the change value of the common voltage, and output the compensation data signal to a pixel electrode of a display panel.

For example, the detection circuit comprises a differential amplifier, which is configured to calculate a difference between a common voltage reference signal and a common voltage feedback signal to obtain the change value of the common voltage.

For example, the compensation circuit comprises an inverting operational amplifier and a non-inverting adder; the inverting operational amplifier is configured to invert and amplify the change value of the common voltage to obtain an amplified common voltage change value, the non-inverting adder is configured to obtain and output the compensation data signal based on the data signal and the amplified common voltage change value.

For example, a non-inverting input terminal of the differential amplifier is connected with a common voltage line through a first resistor, an inverting input terminal of the differential amplifier is connected with a feedback common voltage line through a second resistor, and an output terminal of the differential amplifier is connected with an inverting input terminal of the inverting operational amplifier. The non-inverting input terminal of the differential amplifier is connected with a first voltage terminal through a third resistor, the inverting input terminal and the output terminal of the differential amplifier are connected through a fourth resistor, the output terminal of the differential amplifier is connected with the inverting input terminal of the inverting operational amplifier through a fifth resistor. The inverting input terminal of the inverting operational amplifier is connected with an output terminal of the inverting operational amplifier through a sixth resistor; a non-inverting input terminal of the inverting operational amplifier is connected with a second voltage terminal through a seventh resistor; a non-inverting input terminal of the non-inverting adder is connected with a data signal voltage line through an eighth resistor, an output terminal of the inverting operational amplifier is connected with the non-inverting input terminal of the non-inverting adder through a ninth resistor, an inverting input terminal of the non-inverting adder is connected with an output terminal of the non-inverting adder through a tenth resistor, and the inverting input terminal of the non-inverting adder is connected with a third voltage terminal through an eleventh resistor.

For example, the first voltage terminal, the second voltage terminal and the third voltage terminal are ground voltage terminals.

For example, resistance of the sixth resistor is adjustable.

For example, the common voltage reference signal is generated by a timing control circuit.

For example, the common voltage feedback signal is a common voltage signal of a detection point disposed on the display panel.

For example, the data signal is an initial data signal without common voltage compensation.

At least one embodiment of the present disclosure further provides a display device, which comprises the source drive circuit mentioned above and a display panel connected with the source drive circuit.

For example, the display panel provides the common voltage feedback signal for the source drive circuit, and the source drive circuit provides the compensation data signal to the display panel as least based on the common voltage feedback signal.

For example, the display panel is provided with a detection point for obtaining the common voltage feedback signal.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

An embodiment of the present disclosure provides a source drive circuit with common voltage VCOM compensation. The source drive circuit can receive the feedback of the pulled part of the common voltage VCOM when the common voltage VCOM on the display panel is pulled, an output signal of the source drive circuit can be adjusted by detecting the change value of the common voltage VCOM being pulled (namely, by adjusting the compensation data signal output from the source drive circuit to the pixel electrode, the change value of the common voltage VCOM on the display panel is counteracted), the accuracy of the charging voltage of the pixel on the display panel may be ensured, and the voltage applied on the LCD panel is prevented from being biased, so as to avoid residual charges.

Figure 1A:
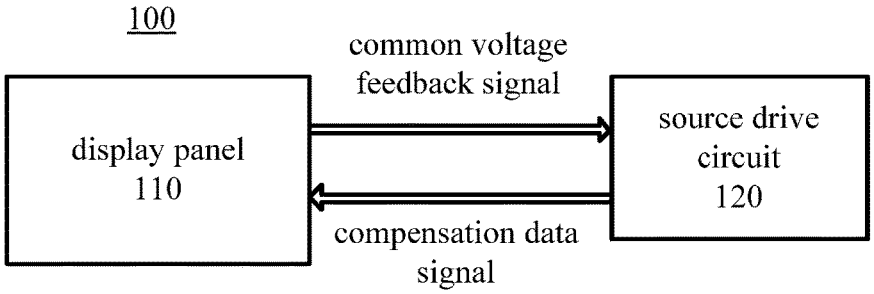
FIG. 1A is a first schematic diagram of a display device provided by an embodiment of the present disclosure.

As shown in FIG. 1A, a display device 100 at least comprises a source drive circuit 120, and a display panel 110 connected with the source drive circuit 120.

Figure 1B:
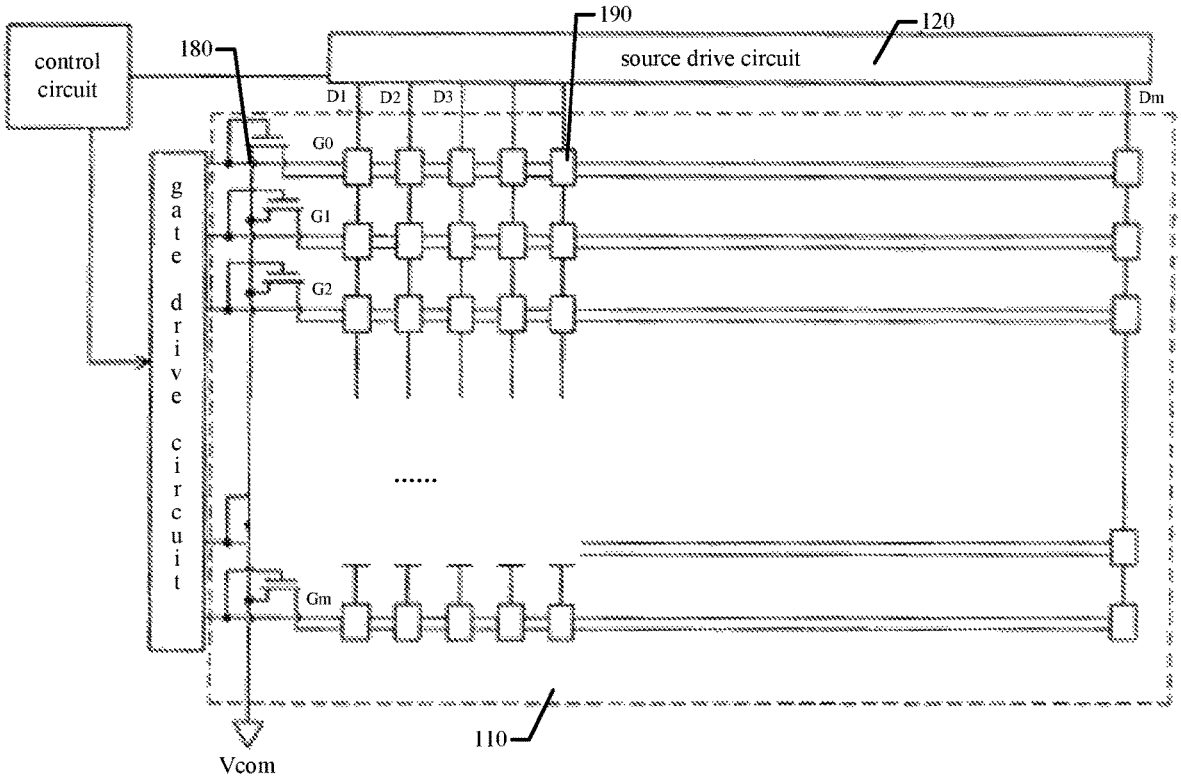
FIG. 1B is a second schematic diagram of a display device provided by an embodiment of the present disclosure

In some embodiments, the display device 100 may further comprise a gate drive circuit, and also may comprise a control circuit (as shown in FIG. 1B). The gate drive circuit sequentially outputs display scan signals used to switch on TFT devices in a row-by-row manner. In addition, the gate drive circuit is further configured to eliminate the shutdown residual and other phenomena. The control circuit is configured to drive the IC control function, that is, the control circuit may convert a control signal of an input interface into control signals which can be identified by the source drive circuit and the gate drive circuit. In an embodiment of the present disclosure, the control circuit may also be configured to output the common voltage VCOM provided to the display panel.

In an embodiment of the present disclosure, the display panel 100 may provide a common voltage feedback signal for the source drive circuit 120 (as shown in FIG. 1A), and the source drive circuit 120 may provide a compensation data signal to the display panel 110 at least based on the received common voltage feedback signal. An approach in which the source drive circuit generates the compensation data signal may be further referred to in FIG. 2.

As shown in FIG. 1B, in some embodiments, at least a plurality of rows of scan lines G0, G1 . . . Gn, a plurality of columns of data lines D0, D1 . . . Dn, a common voltage line Vcom and the control circuit are disposed on the display device 100, and the control circuit may be a timing control circuit. Each scan line is used to transmit a display scan signal so as to select a row of pixels. The source drive circuit 120 may provide a data signal (or the compensation data signal provided by an embodiment of the present disclosure) to a data line disposed on the display panel, so as to charge a corresponding pixel electrode to a corresponding gray scale voltage. The scan lines and the data lines are disposed to cross each other, and pixel units 190 are disposed at the intersections of the scan lines and the data lines, so as to form a pixel array. Each pixel unit 190 comprise a transistor (not shown in figures), a gate electrode of the transistor is connected with a corresponding scan line, a source electrode of the transistor is connected with a corresponding data line, and a drain electrode of the transistor is connected with a pixel electrode. A liquid crystal capacitance may be formed between the pixel electrode and a common electrode connected to the common voltage. In an embodiment of the present disclosure, the source electrode of the transistor is connected with the data line to receive a corresponding compensation data signal.

The common voltage line Vcom shown in FIG. 1B is configured to provide the common voltage to the pixel units 190 of the display panel, and acquisition of the common voltage may be implemented by the control circuit (for example, the timing control circuit). In an embodiment of the present disclosure, the display panel 110 is further configured to input the common voltage feedback signal (as shown in FIG. 1A) to the source drive circuit 120, and the common voltage feedback signal is associated with the common voltage VCOM provided by the common voltage line Vcom. Specifically, the common voltage feedback signal is a voltage signal which is formed due to that the voltage on the common voltage line Vcom is pulled. For example, a specific waveform of the common voltage feedback signal may be measured from a detection point on the display panel 110. As shown in FIG. 1B, a furthest end of the common voltage line disposed on the display panel may be set as the detection point, such as the detection point 180 shown in FIG. 1B, and the common voltage feedback signal is detected and obtained from the detection point 180 in real-time or periodically. Then the detected common voltage feedback signal is input to the source drive circuit 120. It should be understood that, the location of the detection point may be set according to the actual condition, and no limitation will be given herein.

In some embodiments, the common voltage line is connected throughout the whole substrate, and in a case of driving a pixel unit, the common voltage need to be applied to the whole substrate simultaneously, namely, the load which need to be driven by the common voltage VCOM is all pixel units on the whole array substrate. In this case, the detection point for obtaining the common voltage feedback signal may be disposed at a certain point of the substrate.

In some embodiments, the display panel 110 is a liquid crystal display panel or a display panel of another type.

Figure 1C:
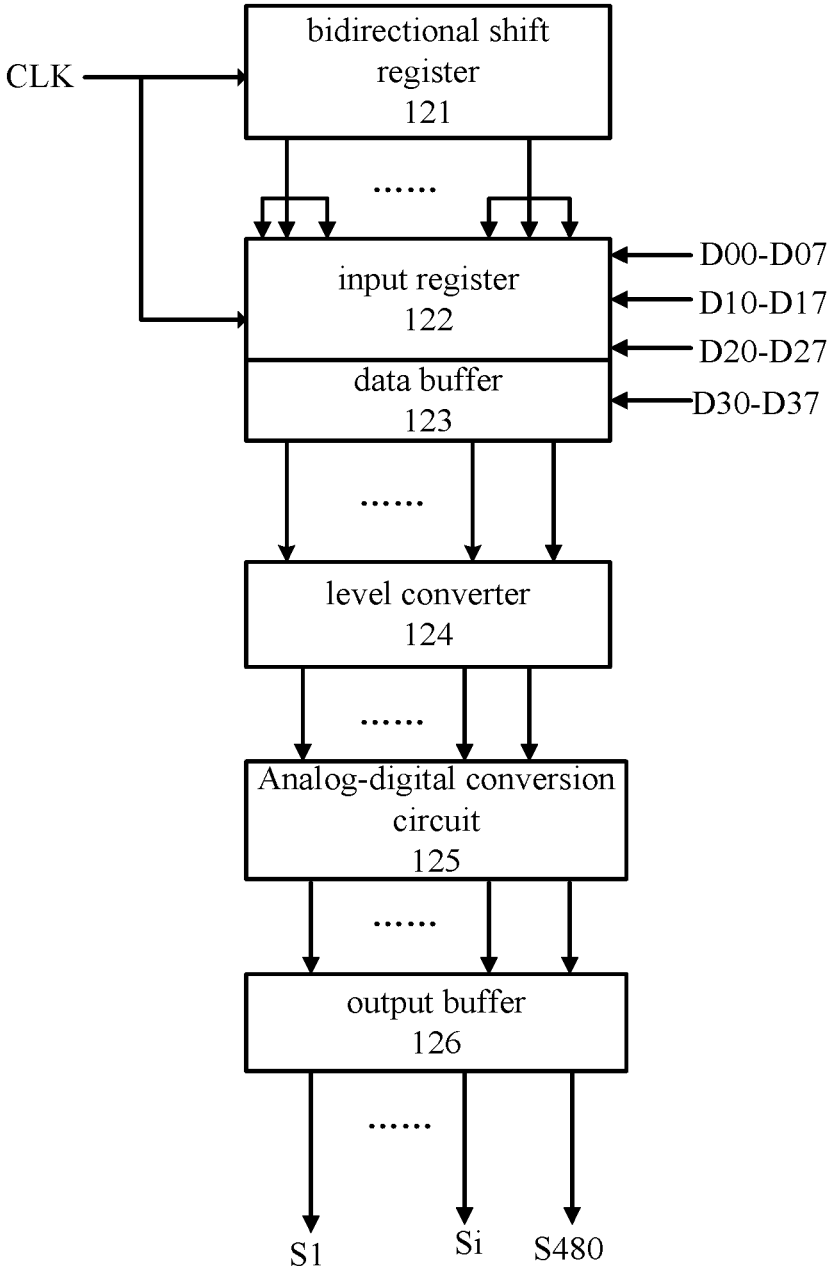
FIG. 1C is a structural schematic diagram of a source drive circuit provided by an embodiment of the present disclosure.

As shown in FIG. 1C, in some embodiments, a structure of the source drive circuit 120 may also comprise a digital part and an analog part. The digital part may comprise a bidirectional shift register 121, an input register 122, a data buffer 123 and a level converter 124 and etc. The analog part comprises an analog to digital conversion circuit 125, an output buffer 126, a charge sharing circuit (not shown in FIG. 1C) and etc. The function of acquiring the compensation data signal in the embodiments of the present disclosure may be further integrated in the output buffer 126.

In addition, in order to conveniently describe the technical solutions of the embodiments of the present disclosure, in the following, an output signal of the source drive circuit without the common voltage compensation is referred to as a data signal. An output signal of the source drive circuit with the common voltage compensation is referred to as a compensation data signal. However, either the compensation data signal or the data signal may be provided to a pixel unit by a data line of the display panel, so as to charge the pixel unit.

In an embodiment of the present disclosure, the compensation data signal (referring to FIG. 2) may be obtained by summing up the data signal and the detected common voltage feedback signal, and then the compensation data signal is provided to a corresponding pixel on the display panel. In particular, the source drive circuit 120 of the embodiments of the present disclosure also integrates the following functions: the source drive circuit 120 analyzes the common voltage feedback signal input from the display panel 110 to obtain a position where the common voltage changes and a change value of the common voltage; then the source drive circuit 120 generates the compensation data signal according to the change situation of the common voltage; finally the source drive circuit 120 inputs the compensation data signal to the corresponding data line of the display panel 110, so as to charge a pixel electrode connected with the corresponding data line to a gray scale voltage corresponding to the compensation data signal.

As shown in FIG. 1C, the function of the bidirectional shift register 121 is to output a shift pulse under the driving of the clock signal CLK, select respective input registers 122 sequentially, and transmit a binary code data signal (for example, D00-D07 in FIG. 1B) input from an interface circuit (for example, RSDS) to a corresponding output channel. The input register 122 and the data buffer 123 both are data registers. The number of the data registers is related to the number of the data channels. For example, in a case that the number of the output channels is 480 channels shown in FIG. 1B, and the transmitted signal is an 8-bits signal, then 7680 data registers are needed. The level converter 124 is configured to boost voltage levels that the data registers output. The reason why the data needs to be boosted is for the need of a subsequent digital-to-analog conversion. After the data input from the level converter 124 is processed by the digital-analog conversion circuit 125, one gray scale voltage selected from analog gray scale voltages generated by a gamma function module is transmitted to the output buffer 126. The output buffer 126 may amplify and output the signal. The output buffer 126 amplifies an analog signal, and an operational amplifier may be used as an analog amplifier. The digital-analog conversion circuit 125 may be a decoding circuit, and may also be a voltage selection function block. The voltage selection function is that the digital-analog conversion circuit 125 selects a required analog voltage (corresponding to the gray scale voltage) according to a digital "password" (corresponding to the gray scale grade) output by the level converter 124. In addition, the output buffer 126 also has the function of receiving the common voltage feedback signal and analyzing the common voltage feedback signal to obtain the compensation data signal. For example, a detection circuit 201 and a compensation circuit 211 shown in FIG. 2 may be integrated into the output buffer 126. The compensation data signal is finally output to a corresponding pixel on the display panel through the data line S1, S2, . . . S480, and the pixel may be charged based on the compensation data signal and the common voltage feedback signal. 480 data lines are shown in FIG. 1B, which is just an example. In an actual source circuit design, the total number of corresponding data lines need to be designed according to the number of the pixels.

A specific structure of the source drive circuit 120 is analyzed one-by-one in conjunction with FIGS. 2-4 below.

Figure 2:
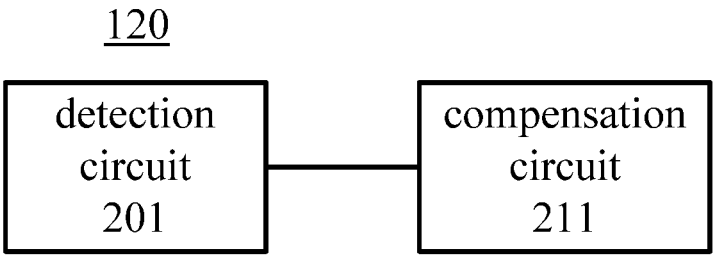
FIG. 2 is a composition schematic diagram of a source drive circuit provided by an embodiment of the present disclosure.

FIG. 2 shows a specific structure of a source drive circuit 120 provided by an embodiment of the present disclosure. The source drive circuit 120 may comprise: a detection circuit 201 and a compensation circuit 211. The detection circuit 201 may be configured to detect a change value of the common voltage VCOM. The compensation circuit 211 is configured to obtain a compensation data signal based on a data signal and the change value of the common voltage VCOM, and output the compensation data signal to a pixel electrode of the display panel through a data line.

In some embodiments, the detection circuit 201 may obtain the change value of the common voltage by detecting parameters such as a position where the common voltage changes, a change amplitude of the common voltage and etc. (for example, detecting the change value of the common voltage may be considered as obtaining a position and amplitude of a waveform change at a point 510 shown in FIG. 5). The change value of the common voltage may be obtained by calculating the difference between the common voltage and the common voltage feedback signal.

Figure 3:
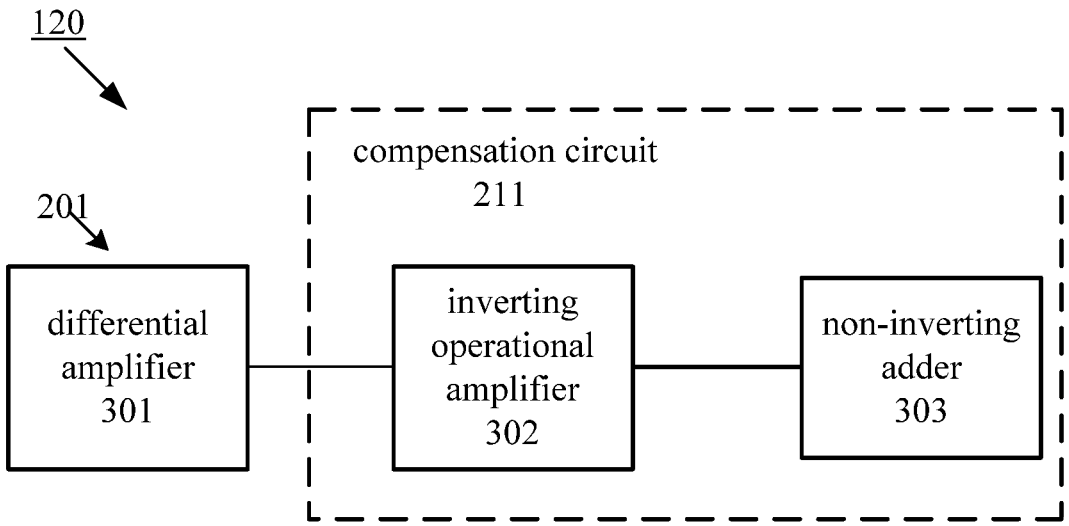
FIG. 3 is a schematic block diagram of a compensation circuit provided by an embodiment of the present disclosure.
Figure 4:
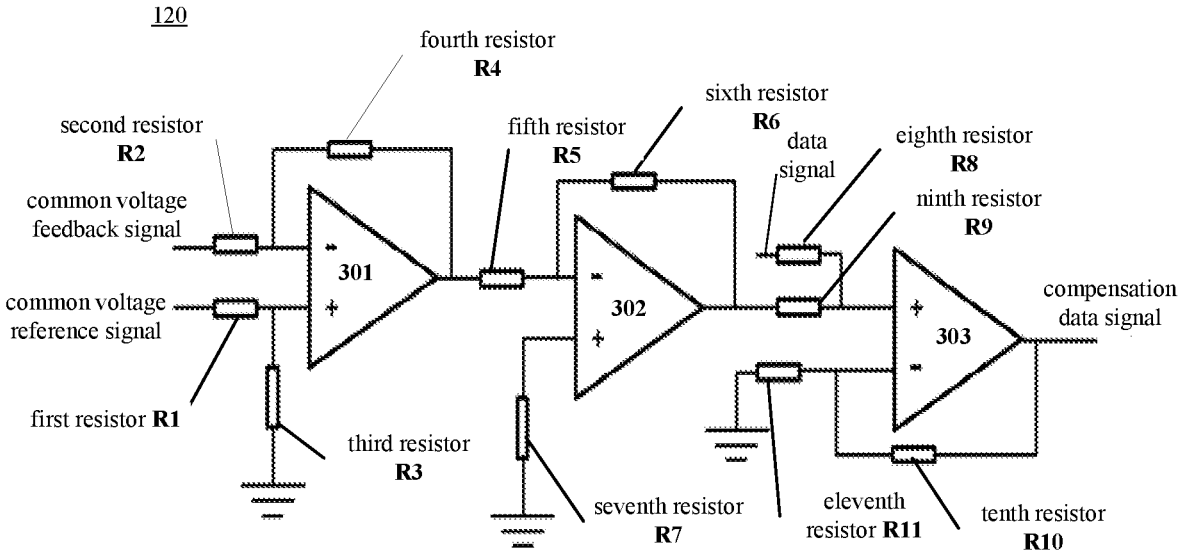
FIG. 4 is a composition schematic diagram of a source drive circuit provided by another embodiment of the present disclosure.

In an embodiment of the present disclosure, the detection circuit 201 may adopt a differential amplifier to obtain the change value of the common voltage (referring to FIG. 3 or FIG. 4 for details). The differential amplifier is a circuit that can amplify the difference between two input voltages. For example, two input voltages of the differential amplifier may be the common voltage reference signal and the common voltage feedback signal respectively. The common voltage reference signal is an initial common voltage signal provided to the display panel by the timing control circuit, and the common voltage feedback signal is the common voltage signal obtained from the detection point disposed on the display panel. The difference between the common voltage feedback signal and the common voltage reference signal is due to the capacitance formed between the common voltage line and the data line on the display panel. In a case that the data signal on the data line is changed, due to the capacitance between the common voltage line and the data line, the common voltage reference signal is pulled, the common voltage signal after being pulled may be measured from the detection point disposed on the display panel, and the measured common voltage signal is the common voltage feedback signal.

In some embodiments, the compensation circuit 211 is configured to obtain the compensation data signal provided to the data line of the display panel by analyzing the output signal of the detection circuit 201. The compensation data signal (for example, the waveform of the compensation data signal may be referred to in FIG. 5) is related to the common voltage feedback signal (for example, the common voltage feedback signal shown in FIG. 5) input by the detection circuit 201, and the relationship between the compensation data signal and the common voltage feedback signal may be referred to in FIG. 5. In conjunction with the content of FIG. 5, the embodiments of the present disclosure can provide the compensation data signal including the characteristics of the pulled part of the common voltage to the pixel electrode on the display panel, and thus the relative stability of the voltage difference between the common voltage signal applied on the common electrode and the data signal applied on the pixel electrode is ensured. Ultimately the distortion of the common voltage caused by the capacitance is overcome.

In an embodiment of the present disclosure, the compensation circuit 211 may comprise an inverting operational amplifier and a non-inverting adder (referring to FIG. 3 and FIG. 4 for details).

In an embodiment of the present disclosure, the detection circuit 201 and the compensation circuit 211 may be both disposed on a substrate of the source drive circuit. For example, the detection circuit 201 and the compensation circuit 211 may be both disposed on an output circuit part of the substrate of the source drive circuit. The detection circuit 201 is connected with the display panel through a signal line, and the signal line is configured to at least transmit the common voltage feedback signal. The compensation circuit 211 is connected with the display panel through the data line, and the data line is configured to provide the compensation data signal to the display panel. The compensation data signal is a data signal generated by analyzing the common voltage feedback signal.

As shown in FIG. 3, the source drive circuit 120 comprises a differential amplifier 301 (the differential amplifier 301 is used to achieve the function of the detection circuit shown in FIG. 2), an inverting operational amplifier 302 and a non-inverting adder 303. For example, the inverting operational amplifier 302 and the non-inverting adder 303 are configured to achieve the function of the compensation circuit 211.

The differential amplifier 301 is configured to perform a differential operation between the common voltage reference signal and the common voltage feedback signal to obtain the change value of the common voltage.

correspondingly, the inverting operational amplifier 302 is configured to invert and amplify the change value of the common voltage obtained by the differential amplifier 301 to obtain an amplified common voltage change value, and the non-inverting adder 303 is configured to obtain and output the compensation data signal based on the data signal and the amplified common voltage change value.

In some embodiments, a magnification factor of the inverting operational amplifier 302 is adjustable.

In some embodiments, the non-inverting adder 303 is configured to superimpose the detected change value of the common voltage to the data signal, and output the superposition result to the data line of the display panel.

FIG. 4 is a specific structure schematic diagram of the source drive circuit 120.

A non-inverting input terminal of the differential amplifier 301 is connected with a common voltage line through a first resistor R1 to receive the common voltage reference signal, an inverting input terminal of the differential amplifier 301 is connected with a feedback common voltage line through a second resistor R2 to receive the common voltage feedback signal, and an output terminal of the differential amplifier 301 is connected with an inverting input terminal of the inverting operational amplifier 302. In addition, the non-inverting input terminal of the differential amplifier 301 is also connected with a first voltage terminal through a third resistor R3. The inverting input terminal and the output terminal of the differential amplifier 301 are connected through a fourth resistor R4.

The output terminal of the differential amplifier 301 is connected with the inverting input terminal of the inverting operational amplifier 302 through a fifth resistor R5, the inverting input terminal of the inverting operational amplifier 302 is connected with an output terminal of the inverting operational amplifier 302 through a sixth resistor R6, and a non-inverting input terminal of the inverting operational amplifier 302 is connected with a second voltage terminal through a seventh resistor R7.

A non-inverting input terminal of the non-inverting adder 303 is also connected with a data signal line through an eighth resistor R8 to receive the data signal, an output terminal of the inverting operational amplifier 302 is connected with the non-inverting input terminal of the non-inverting adder 303 through a ninth resistor R9, an inverting input terminal of the non-inverting adder 303 is connected with an output terminal of the non-inverting adder 303 through a tenth resistor R10, and the inverting input terminal of the non-inverting adder 303 is connected with a third voltage terminal through an eleventh resistor R11.

For example, the data signal is $S_{data}$, the compensation data signal is $S_{compensation}$, the output signal of the inverting operational amplifier 302 is $S_{out\text{-}inv\text{-}amp}$, then the the compensation data signal $S_{compensation}$ is represented as:

$$S_{compensation} = \frac{R10 + R11}{R11} \times \frac{S_{data}R8 + S_{out\text{-}inv\text{-}amp}R9}{R8 + R9}.$$

In some embodiments, the first voltage terminal, the second voltage terminal and the third voltage terminal as mentioned above may all be ground voltage terminals simultaneously. The first voltage terminal, the second voltage terminal and the third voltage terminal may all be voltage terminals with fixed voltages.

In some embodiments, resistance of the sixth resistor R6 as mentioned above is adjustable. The magnification factor of the inverting operational amplifier 302 may be changed by adjusting the resistance of the sixth resistor R6.

In some embodiments, the common voltage reference signal is generated by a timing control circuit.

In some embodiments, the common voltage feedback signal is a common voltage signal of a detection point disposed on the display panel. For example, the common voltage feedback signal may be obtained by continuously detecting the common voltage at the detection point by a voltage measuring circuit.

In some embodiments, the data signal is a data signal output from the source drive circuit to the data line of the display panel with no common voltage compensation, namely the data signal is referred to as an initial data signal. Specifically, in an embodiment, the data signal is used as an input signal of the non-inverting input terminal of the non-inverting adder 303.

The embodiments of the present disclosure may use an approach in which the differential amplifier 301, the inverting operational amplifier 302 and the non-inverting adder 303 are connected in cascade to achieve the technical purposes of the present disclosure. However, without departing from the technical concept, those skilled in the art can adopt other circuits which are different from the circuits of the present application, and the other circuits should be within the scope of the present disclosure. For example, the input signals of the differential amplifier 301 shown in FIG. 3 are the common voltage reference signal and the common voltage feedback signal. The differential amplifier 301 may calculate the difference between the common voltage reference signal and the common voltage feedback signal, so as to obtain a part of the common voltage signal being pulled. Then the part of the common voltage signal being pulled is input to the inverting operational amplifier 302. Next the inverting operational amplifier 302 inverts and amplifies the part of the common voltage signal being pulled. By controlling the magnification factor of the inverting operational amplifier 302 (for example, by changing the resistance of the sixth resistor R6), finally the source drive circuit is controlled to output the compensation data signal. The output circuit of the source drive circuit may be implemented by the non-inverting adder 303. An input signal of one terminal of the non-inverting adder 303 is the output signal after inverting and amplifying by the inverting operational amplifier 302, and an input signal of another terminal of the non-inverting adder 303 is the data signal. After the operation of the non-inverting adder 303, the part of the common voltage signal being pulled is reflected in the output signal of the source drive circuit, so as to achieve compensating the data signal output by the source drive circuit. By keeping the difference between the compensation data signal and the common voltage signal being pulled to be relatively stable, many problems caused by a situation that the common voltage signal is pulled may be overcome.

In some embodiments, the differential amplifier 301 is used as a pull extraction circuit of the common voltage Vcom. The differential amplifier 301 may extract and amplify the pulled part of the common voltage Vcom. In a specific design, the differential amplifier 301 may be disposed on the source drive printed circuit board S-PCB. The inverting operational amplifier 302 may also be disposed on the source drive printed circuit board S-PCB. In addition, a part of the non-inverting adder 303 may also be disposed on a source drive circuit S-Driver.

In some embodiments, the non-inverting adder 303 may add the pulled part of the common voltage to the data signal S-output output by a normal source drive circuit (namely the source drive circuit without the compensation of the common voltage feedback signal), and the superposition result is used as the compensation data signal. Then the source drive circuit inputs the compensation data signal to the data line of the display panel. For example, a correspondence between a waveform of the common voltage feedback signal and a waveform of the compensation data signal obtained based on the common voltage feedback signal may be referred to in FIG. 5.

Figure 5:
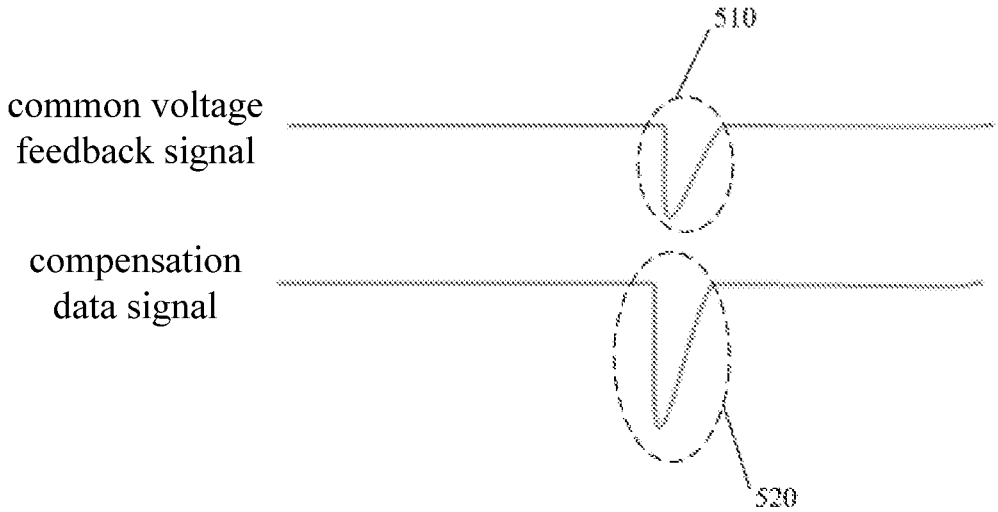
FIG. 5 is a schematic diagram of comparison between a common voltage feedback signal and a compensation data signal provided by an embodiment of the present disclosure.

As shown in FIG. 5, this figure provides a waveform of the common voltage feedback signal obtained by measuring the detection point and a waveform of the compensation data signal generated by the source drive circuit. It can be seen from FIG. 5 that the waveform of the common voltage feedback signal reflects the change situation of the common voltage VCOM, and the change situation of the common voltage VCOM is located at the position 510 in FIG. 5. In an embodiment of the present disclosure, the differential amplifier 301 shown in FIG. 4 may be adopted to detect the change situation of the voltage at the position 510. For example, the common voltage reference signal and the common voltage feedback signal may be taken as the non-inverting input signal and the inverting input signal of the differential amplifier 301 respectively, and then the differential amplifier 301 may calculate the difference of the two signals and amplify the difference to obtain the change value at the position 510.

In addition, It can be seen from FIG. 5 that the pulled part of the compensation data signal corresponds to the pulled part of the common voltage feedback signal (namely in FIG. 5, the position of 510 and the position of 520 are the same, and the amplitude at the 510 is related to the amplitude at the 520). However the difference of the two pulled parts remains relatively constant, which may further ensure that many problems caused by the change of the common voltage are counteracted on the display panel. In addition, the change amplitude at the position 520 in FIG. 5 may be adjusted, and the change amplitude at the position 520 may be adjusted by adjusting the resistance of the sixth resistor R6 of the inverting operational amplifier 302 in FIG. 4.

With reference to the waveforms in FIG. 5, it can be seen that in the embodiments of the present disclosure the difference between the compensation data signal and the common voltage feedback signal can be keep relatively stable, so that the stability of the voltages applied on a source electrode and a drain electrode of a transistor included in a pixel can be further ensured.

In summary, through detecting the change of the common voltage on the display panel, the embodiments of the present disclosure may adjust the output signal of the source drive circuit based on the change of the common voltage. Thus, the accuracy of the charging voltage on the pixel can be ensured, and the voltage applied on the liquid crystal can be prevented from being biased, so as to avoid the residual charge. The present disclosure provides a source drive circuit with common voltage VCOM compensation. When the common voltage VCOM on the display panel is pulled, the pulled part of the common voltage VCOM is fed back to the output part of the source drive circuit S-Driver, then the output signal of the source drive circuit S-Driver (e.g., the data signal in FIG. 4) is adjusted by detecting the pulled part of the common voltage VCOM, so that correctness of the charging voltage of the pixel on the display panel may be ensured, and the voltage applied on the liquid crystal is prevented from being biased, so as to avoid charge residuals.

Only the structures involved in the embodiments of the present invention are involved in the drawings of the present disclosure, and other structures can be referred to usual designs. The features in different embodiments or different features in the same embodiment can be combined without conflict.

What have been described above are only specific implementations of the present disclosure, the protection scope of the present disclosure is not limited thereto. Any modifications or substitutions easily occur to those skilled in the art within the technical scope of the present disclosure should be within the protection scope of the present disclosure. Therefore, the protection scope of the present disclosure should be based on the protection scope of the claims.

The application claims priority to the Chinese patent application No. 201611053935.1, filed Nov. 24, 2016, the entire disclosure of which is incorporated herein by reference as part of the present application.

What is claimed is:

1. A source drive circuit, comprising:

a detection circuit, configured to detect a change value of a common voltage based on a common voltage feedback signal input by a display panel; and a compensation circuit, configuration to obtain a compensation data signal based on a data signal and the change value of the common voltage, and output the compensation data signal to a pixel electrode of the display panel, wherein the detection circuit comprises a differential amplifier, configured to calculate a difference between a common voltage reference signal and the common voltage feedback signal to obtain the change value of the common voltage, the compensation circuit comprises an inverting operational amplifier and a non-inverting adder, the inverting operational amplifier is configured to invert and amplify the change value of the common voltage to obtain an amplified common voltage change value, and the non-inverting adder is configured to obtain and output the compensation data signal based on the data signal and the amplified common voltage change value, a non-inverting input terminal of the differential amplifier is connected with a common voltage line through a first resistor, an inverting input terminal of the differential amplifier is connected with a feedback common voltage line through a second resistor, the non-inverting input terminal of the differential amplifier is connected with a first voltage terminal through a third resistor, and the inverting input terminal and an output terminal of the differential amplifier are connected through a fourth resistor;

the output terminal of the differential amplifier is connected with an inverting input terminal of the inverting operational amplifier through a fifth resistor, the inverting input terminal of the inverting operational amplifier is connected with an output terminal of the inverting operational amplifier through a sixth resistor; and a non-inverting input terminal of the inverting operational amplifier is connected with a second voltage terminal through a seventh resistor; and a non-inverting input terminal of the non-inverting adder is connected with a data signal voltage line through an eighth resistor, the output terminal of the inverting operational amplifier is connected with the non-inverting input terminal of the non-inverting adder through a ninth resistor, an inverting input terminal of the non-inverting adder is connected with an output terminal of the non-inverting adder through a tenth resistor, and the inverting input terminal of the non-inverting adder is connected with a third voltage terminal through an eleventh resistor.

2. The source drive circuit according to claim 1, wherein the first voltage terminal, the second voltage terminal, and the third voltage terminal are ground voltage terminals.

3. The source drive circuit according to claim 1, wherein resistance of the sixth resistor is adjustable.

4. The source drive circuit according to claim 1, wherein the common voltage reference signal is generated by a timing control circuit.

5. The source drive circuit according to claim 1, wherein the common voltage feedback signal is a common voltage signal of a detection point disposed on the display panel.

6. The source drive circuit according to claim 1, wherein the data signal is an initial data signal without common voltage compensation.

7. A display device, comprising:

the source drive circuit according to claim 1; and a display panel connected with the source drive circuit.

8. The display device according to claim 7, wherein the display panel provides the common voltage feedback signal for the source drive circuit, and the source drive circuit provides the compensation data signal to the display panel at least based on the common voltage feedback signal.

9. The display device according to claim 7, wherein the display panel is provided with a detection point for obtaining the common voltage feedback signal.

10. A source drive circuit, comprising:

a detection circuit, configured to detect a change value of a common voltage; and a compensation circuit, configured to obtain a compensation data signal based on a data signal and the change value of the common voltage, and output the compensation data signal to a pixel electrode of a display panel, wherein the detection circuit comprises a differential amplifier, configured to calculate a difference between a common voltage reference signal and a common voltage feedback signal to obtain the change value of the common voltage, the compensation circuit comprises an inverting operational amplifier and a non-inverting adder, wherein the inverting operational amplifier is configured to invert and amplify the change value of the common voltage to obtain an amplified common voltage change value, and the non-inverting adder is configured to obtain and output the compensation data signal based on the data signal and the amplified common voltage change value, a non-inverting input terminal of the differential amplifier is connected with a common voltage line through a first resistor, an inverting input terminal of the differential amplifier is connected with a feedback common voltage line through a second resistor, the non-inverting input terminal of the differential amplifier is connected with a first voltage terminal through a third resistor, and the inverting input terminal and an output terminal of the differential amplifier are connected through a fourth resistor, the output terminal of the differential amplifier is connected with an inverting input terminal of the inverting operational amplifier through a fifth resistor, the inverting input terminal of the inverting operational amplifier is connected with an output terminal of the inverting operational amplifier through a sixth resistor; and a non-inverting input terminal of the inverting operational amplifier is connected with a second voltage terminal through a seventh resistor, and a non-inverting input terminal of the non-inverting adder is connected with a data signal voltage line through an eighth resistor, the output terminal of the inverting operational amplifier is connected with the non-inverting input terminal of the non-inverting adder through a ninth resistor, an inverting input terminal of the non-inverting adder is connected with an output terminal of the non-inverting adder through a tenth resistor, and the inverting input terminal of the non-inverting adder is connected with a third voltage terminal through an eleventh resistor.

* * * * *